United States Patent [19]

Kamke et al.

[11] Patent Number: 4,843,849

[45] Date of Patent: Jul. 4, 1989

[54] DOOR LOCK MECHANISM FOR A MOTOR VEHICLE

[75] Inventors: Reinhard Kamke, Hainburg; Hermann A. Bartels, Muehlheim; Horst Heseler, Bad Vilbel; Rainer Srock, Leonberg; Georg Eger, Hochdorf, all of Fed. Rep. of Germany

[73] Assignee: Dr. Ing. h.c. F. Porsche Aktiengesellschaft, Fed. Rep. of Germany

[21] Appl. No.: 904,342

[22] Filed: Sep. 5, 1986

[30] Foreign Application Priority Data

Sep. 7, 1985 [DE] Fed. Rep. of Germany ..... 3531931

[51] Int. Cl.[4] ..... E05B 65/36

[52] U.S. Cl. ..... 70/264; 292/201; 292/DIG. 3

[58] Field of Search ..... 292/201, 216, 210, 201, 292/341.16, DIG. 43, DIG. 29, DIG. 3; 70/264, 279, 281; 180/289

[56] References Cited

U.S. PATENT DOCUMENTS

| | | | |
|---|---|---|---|
| 2,916,319 | 12/1959 | Du Bois | 292/341.16 |
| 2,943,880 | 7/1960 | Joachim et al. | 292/DIG. 43 X |
| 3,989,287 | 11/1976 | Sheesley | 292/201 |
| 4,468,941 | 9/1984 | Bascou | 292/201 X |
| 4,492,395 | 1/1985 | Yamada | 292/216 |
| 4,518,182 | 5/1985 | Cousin et al. | 292/201 |
| 4,569,544 | 2/1986 | Escaravage | 292/201 X |
| 4,588,217 | 5/1986 | Escaravage | 292/201 |
| 4,597,598 | 7/1986 | Bascou | 292/201 X |
| 4,652,027 | 3/1987 | Quantz | 292/DIG. 43 X |
| 4,667,991 | 5/1987 | Pèbre | 292/201 |

FOREIGN PATENT DOCUMENTS

| | | | |
|---|---|---|---|
| 2811990 | 9/1979 | Fed. Rep. of Germany | 70/264 |

*Primary Examiner*—Lloyd A. Gall

*Attorney, Agent, or Firm*—W. G. Fasse; D. H. Kane, Jr.

[57] ABSTRACT

A motor vehicle door lock is equipped for cooperation with a central locking system able to lock all doors of a vehicle from a single control. The lock also has a pull closed mechanism which is driven by the same motor driving the locking elements in response to a signal from the central locking system. The pull closed mechanism cooperates with a fork latch for bringing the fork latch from a preliminary latching position into a main or final latching position, whereby door slamming for properly closing a vehicle door is not necessary. It is now sufficient if the user closes the door so that the fork latch is in its preliminary latching position since the present invention mechanism will then close the vehicle door completely.

8 Claims, 10 Drawing Sheets

DOOR LOCK MECHANISM FOR A MOTOR VEHICLE

FIELD OF THE INVENTION

The invention relates to a door lock mechanism, especially for motor vehicles in which all the door locks are under the control of a central locking or interlocking system.

DESCRIPTION OF THE PRIOR ART

Such systems comprise an electrical control and an electrical driving mechanism for the operation of the locking mechanism in response to a central control signal. Each door lock comprises a housing and a fork latch having a preliminary latching member and a main latching member cooperating with a detent rotatably mounted in the housing. A central control element cooperates through lever and linkage members with an outer door handle, an inner door handle, an inner locking member such as a button, and generally also with a door locking cylinder. The just described lock mechanism is well known in the art and these mechanisms generally satisfy the respective requirements. However, recently problems have been encountered due to the fact that the door seals in modern cars oppose the closing motion of a door with a substantial resistance. As a result, it is necessary to slam the door with a sufficient force to overcome that resistance. Such door slamming is rather noisy in spite of the door seals.

OBJECTS OF THE INVENTION

In view of the foregoing it is the aim of the invention to achieve the following objects singly or in combination:

to construct a locking mechanism in such a way that the door slamming noises are substantially avoided, or at least reduced even if the door seal requires a substantial door closing force;

to construct the door lock so that it is simple, while still permitting the cooperation with the central door locking system;

to provide a door lock mechanism capable of completely closing a door, or rather pulling it closed, after the door has been brought into a preliminary partially closed position;

to use the driving mechanism which is provided for the central door locking, also for pulling the door into a completely closed position from a preliminary closed position; and to construct the lock in such a way that the electrical driving mechanism will require but one rotational direction.

SUMMARY OF THE INVENTION

A vehicle door lock mechanism as described above is equipped according to the invention with a pull closed mechanism which pulls the fork latch out of its preliminary latching position into its final or main latching position, whereby the driving force for the pull closed mechanism is derived from the driving means of the central locking system. Thus, with the aid of the pull closed mechanism it is no longer necessary to bring the fork latch into its final or main latching position by a forceful door slamming. Rather, it is now sufficient to close the vehicle door to such an extent that the fork latch will tilt out of its fully open position into a preliminary latching position because the final portion of the closing door movement is accomplished by the pull closed mechanism which brings the fork latch into the main or final latching position. The operation of the pull closed mechanism is responsive to the fork latch reaching its preliminary latching position. The pull closed mechanism is driven electrically by the electrical drive of the central locking mechanism, whereby noise is minimized. Further, the double utilization of the electric drive mechanism for the central locking purpose, as well as for the pull closed purpose results in a more efficient use of the electrical drive mechanism which is rather simple because it is sufficient for both purposes even if the electrical drive motor is rotating in each instance in the same direction.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
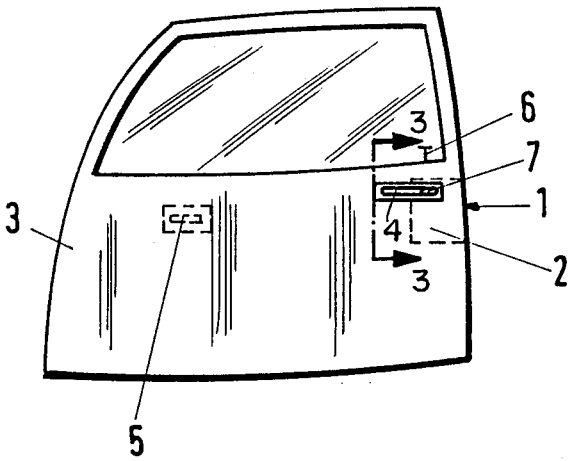
FIG. 1 is a view of a vehicle door.
Figure 2:
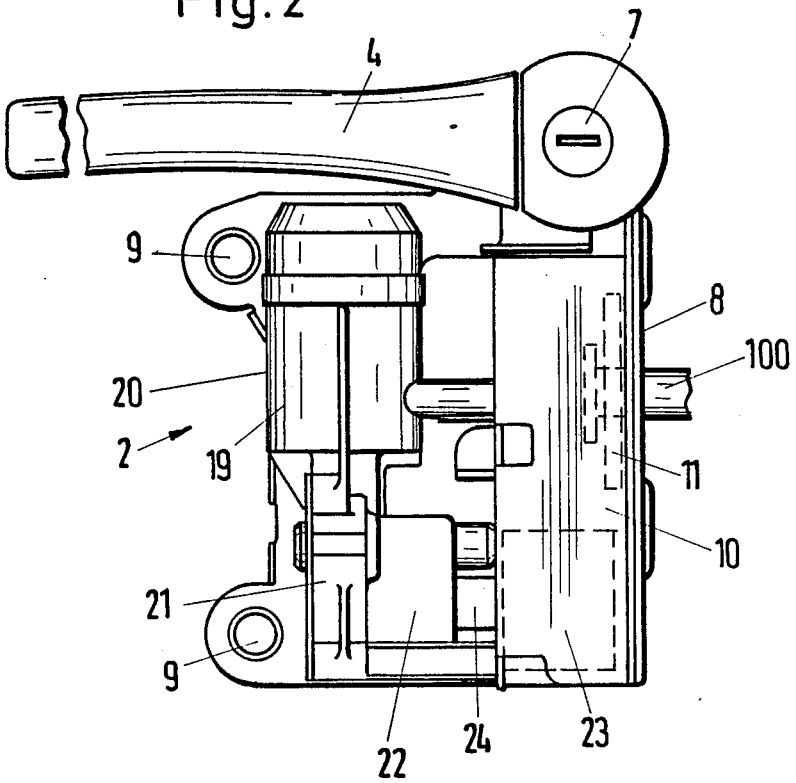
FIG. 2 is an overall view of the door lock mechanism.

FIG. 1 shows the overall view of a vehicle door comprising a door lock mechanism 1 including the door lock 2 for each door 3 having an outer door handle 4, an inner door handle 5, and an inner locking button 6. The lock normally includes a locking cylinder 7 operable by a key, whereby these components are connected to the lock 2 proper through levers and linkage means as is conventional. The door lock 2 further comprises a housing 8 including mounting openings 9 and a cover plate 10 as shown in FIG. 2. A pull closed mechanism includes a latch fork 11 best seen in FIG. 6. The latch fork 11 is located below the cover plate 10. The latch fork 11 has two latching members 12 and 13 forming part of said pull closed mechanism. The first latching member 12 provides for a preliminary or first latching position while the second latching member 13 holds a door in a second or final door closed latched position. The latch fork 11 is journalled on a shaft 14 rigidly mounted in the housing 8. A detent 15 holds the latch fork 11 in the above mentioned first or preliminary latching position or in the second or final latching position. The detent 15 has a cam 15*a* for holding the latch fork as just described. The detent 15 is journalled on a shaft 16 rigidly mounted in the housing 8. Both, the latch fork 11 and the detent 15 are biased by a respective spring.

As soon as the latch fork 11 is tilted by a locking bolt 100 which contacts the latch fork 11 when the vehicle door 3 is being closed, the preliminary latching member 12 of the latch fork 11 engages the detent 15, whereby a control surface 17 of the latch fork 11 activates an electric switch 18 for closing an energizing circuit for an electric motor 19 shown in FIG. 2 for a pull closed operation. The motor 19 forms part of the lock drive means 20 to be described in more detail below. However, the key for the lock 7 is not used for the pull closed operation.

The lock drive means 20 in turn form part of a central lock control system including the drive motor 19, a worm gear drive 21, a reduction gear 22, and a central locking unit 23 connected to the reduction gear 22 through a drive shaft 24 of the gear 22 as shown in FIG. 2.

Figure 6:
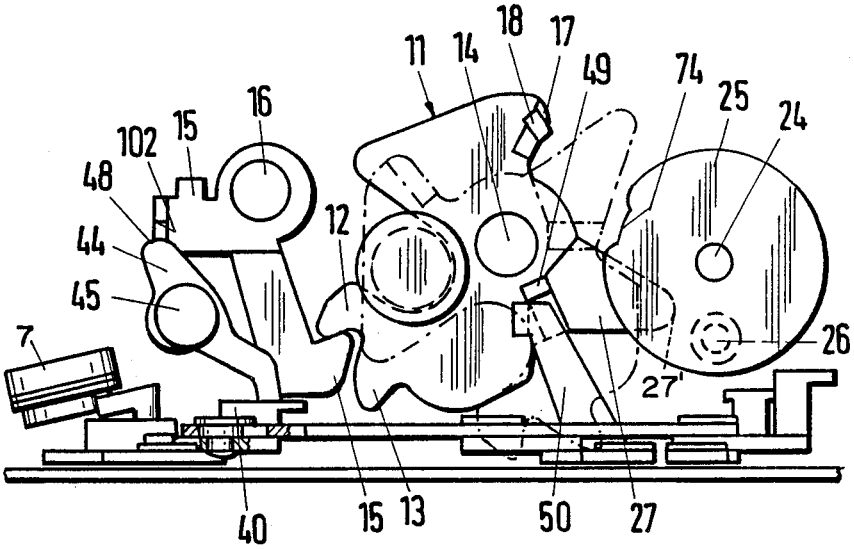
FIG. 6 is a view similar to that of FIG. 5, but rotated by 180° for showing the essential lock components in a first or preliminary latching position.
Figure 8:
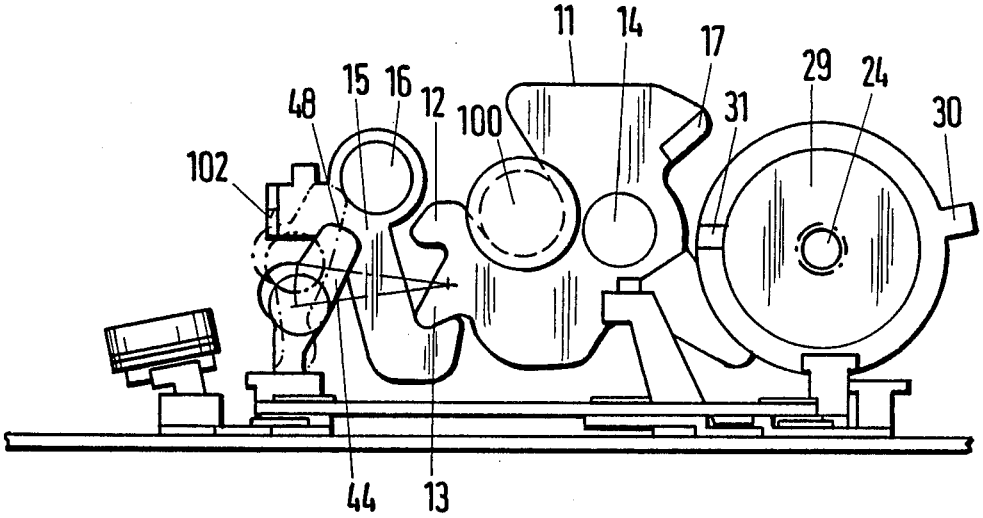
FIG. 8 is a view similar to FIG. 6, however showing the lock components in a second or main latching position which also corresponds to the position when the lock has been locked by central lock control means.
Figure 9:
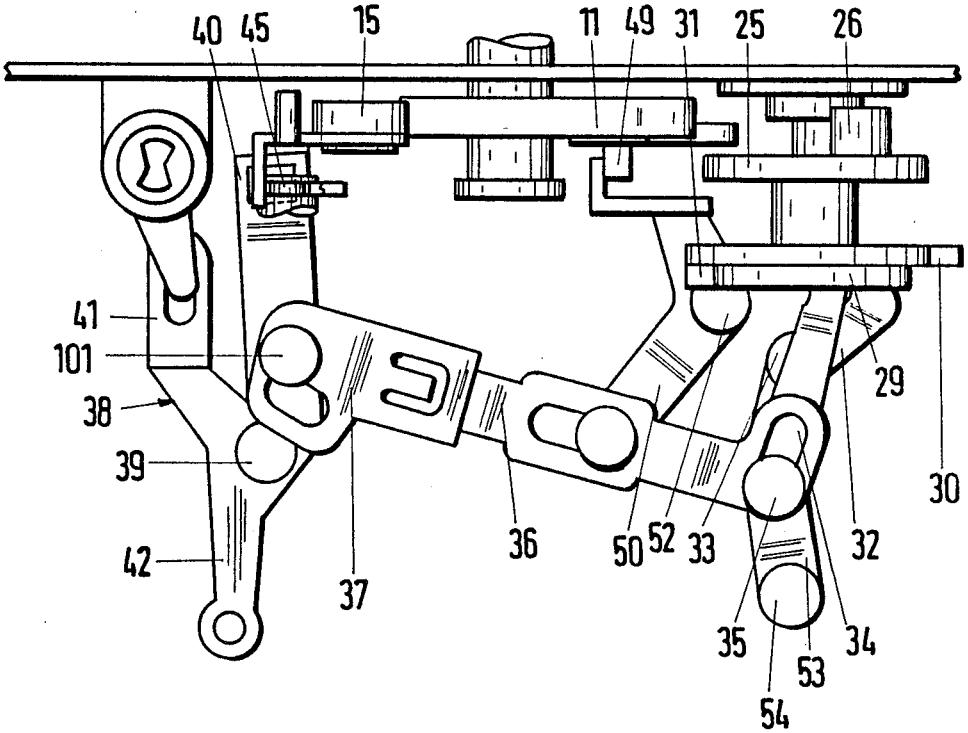
FIG. 9 is a view as in FIG. 7, however showing the lock components in the centrally locked position.
Figure 10:
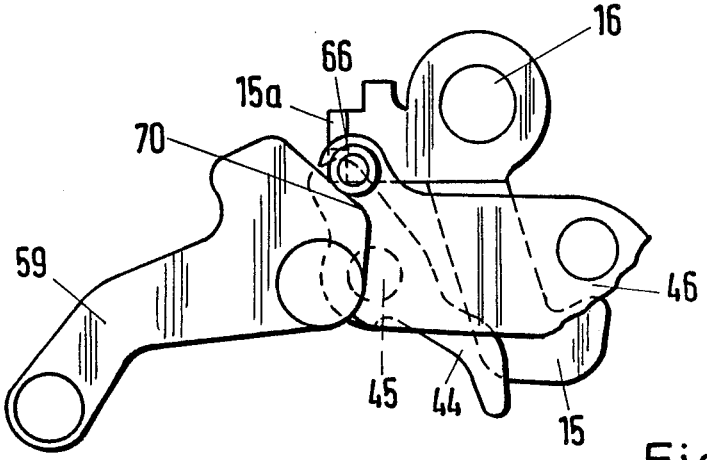
FIG. 10 is a plan view onto lock components for opening the door lock.
Figure 11:
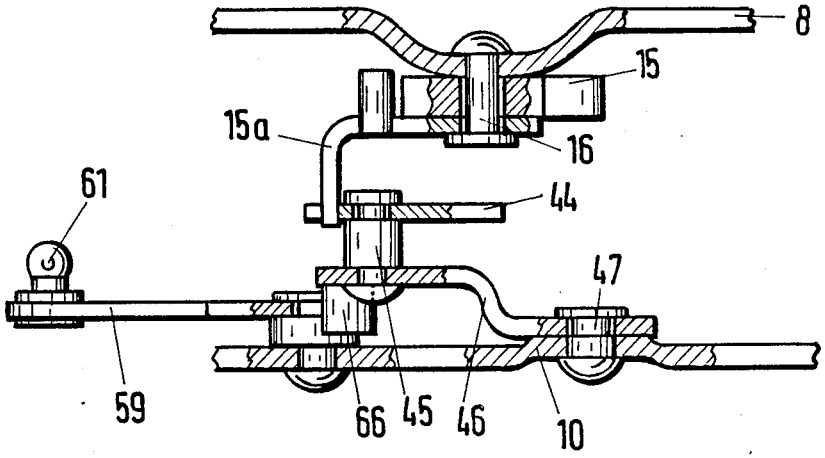
FIG. 11 is a side view of the lock components of FIG. 10.

The central locking unit 23 comprises a drive disk 25 carrying a drive bolt which in turn journals a roller 26. The drive disk 25 is freely rotatable on the drive shaft 24 and connectable to the drive shaft 24 by an entraining lever 73 forming part of an emergency release mechanism 71 to be described below. The entraining lever 73 transmits power from the drive shaft 24 to the drive roller 26 when the entraining lever 73 is engaged. The entraining lever is engaged when the switch 18 closes a circuit for energizing the electromotor 19, thereby rotating the drive shaft 24 and thus the drive disk 25 by 360° for a pull closed operation, whereby the drive roller 26 engages an arm 27 of the fork latch 11 to thereby tilt the fork latch 11 to such an extent that the main latching member 13 engages the detent 15 to establish the second or main latching position or condition. Thus, the motor 19 has pulled the fork latch 11 from the past preliminary latching position into the second main latch position during the pull closed operation. The first or preliminary latching position is shown in FIG. 6. The second or main latching position is shown in FIG. 8. The components participating in this pull closing operation include the control surface 17 on the latch fork 11, the electric switch 18, the motor 19, the entraining lever 73, the drive disk 25 with its roller 26, and the latch fork arm 27. These components are thus referred to as the pull closed mechanism.

In order to prevent locking of a door lock 2 at a time when any door is being closed or to prevent a burn out of the electric motor 19 if any door 3 is still open and the safety lever 38 is in its locking position with the button 6 down, the latch fork 11 is provided with a link control cam 49 which moves, as a result of closing the door from the position shown in FIG. 6 into the position shown in FIG. 8. Closing of the door causes the fork latch 11 to move from the first or preliminary latching position into the second or final latching position for the purpose of automatically pulling the door 3 completely closed. As a result of this operation, a deflection link or lever 50 is tilted about its axis 52 rigidly secured to the housing 8 to thereby bring a transfer lever 36 into its effective position.

When the latch fork 11 is in its second final position and the door 3 is full closed, the central locking is immediately ready for the central locking operation by a key or by the button 6. This central locking operation derives its power also from the electric motor 19.

The central locking is accomplished by operating the locking cylinder 7, for example, with the aid of a key. For this purpose the locking cylinder 7 controls a second electric switch 28 which closes the energizing circuit of the electric motor 19 immediately upon rotation of the locking cylinder 7 by a key so that the motor 19 or rather its shaft, can continue to rotate in the same rotational direction as it did during the pull closed operation. During this central locking operation the central locking unit 23 or rather a cam disk 29 forming part of the central locking unit 23, are now rotated by the drive shaft 24 through an angle of 140° and not through 360° as is the case for the pull closed operation. The cam disk 29 carries two cams 30 and 31 which are displaced radially and axially from one another so as to enclose an angle with each other at the circumference of the cam disk 29, please see FIGS. 4 and 5.

Figure 4:
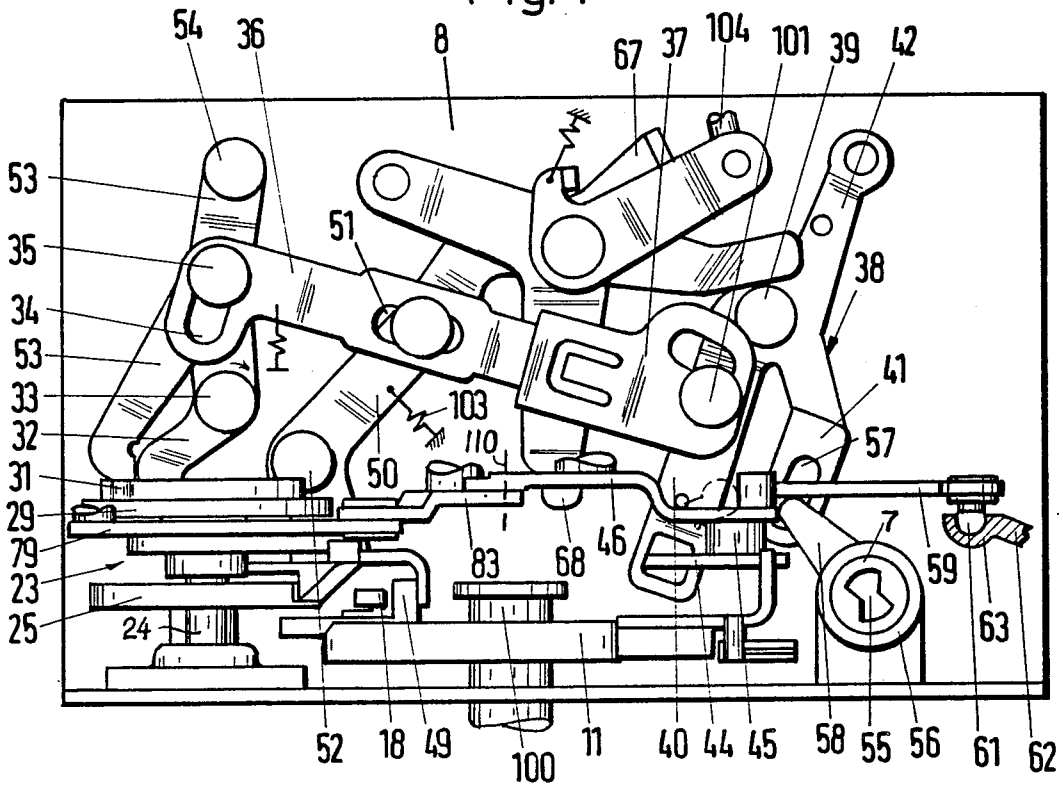
FIG. 4 is a view in the same direction as FIG. 2, however, on an enlarged scale and without the drive motor, without the cover member, and without the outer door handle, however, rotated clockwise by 90° relative to FIG. 2.
Figure 5:
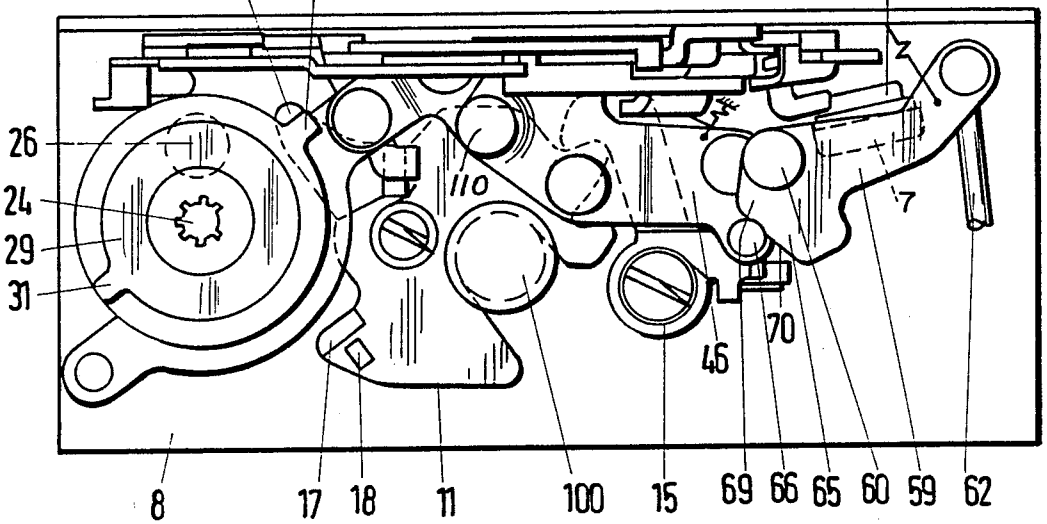
FIG. 5 is a view in the same direction as FIG. 3, however, on an enlarged scale, and without the motor, without the cover member, without the locking cylinder, and without the outer door handle, however, rotated counterclockwise relative to FIG. 3.

When the drive shaft 24 rotates counterclockwise out of the second or main latching position according to FIG. 5, the cam 30 engages a tilting lever 32 tiltably mounted on a shaft 33 rigidly secured to the housing 8. The tilting lever 32 is a rocker type lever which is pivoted, in a longitudinal hole 34, by means of a bolt 35 to a transmitting lever 36, whereby the latter is displaced to the right in the longitudinal direction when the tilting lever 32 is tilted clockwise as shown in FIG. 4 showing the condition when the door is closed. A further tilting lever 53 is pivoted to the bolt 35 so that it is simultaneously brought into a ready position. The function of the second tilting lever 53 will be described in more detail below. The other end 37 of the transmitting lever 36 is pivoted to a safety lever 38 by means of a bolt 101. The safety lever 38 is tiltably secured on an axis 39 rigidly mounted in the housing 8. Further, the safety lever 38 has two forked arms 40 and 41 as well as a third arm 42. The transmitting lever 36 has a L-shaped elongated hole in its end 37, whereby the transmitter lever 36 is pivoted to the arm 40 of the safety lever 38 in a tiltable and in a displaceable manner.

Figure 7:
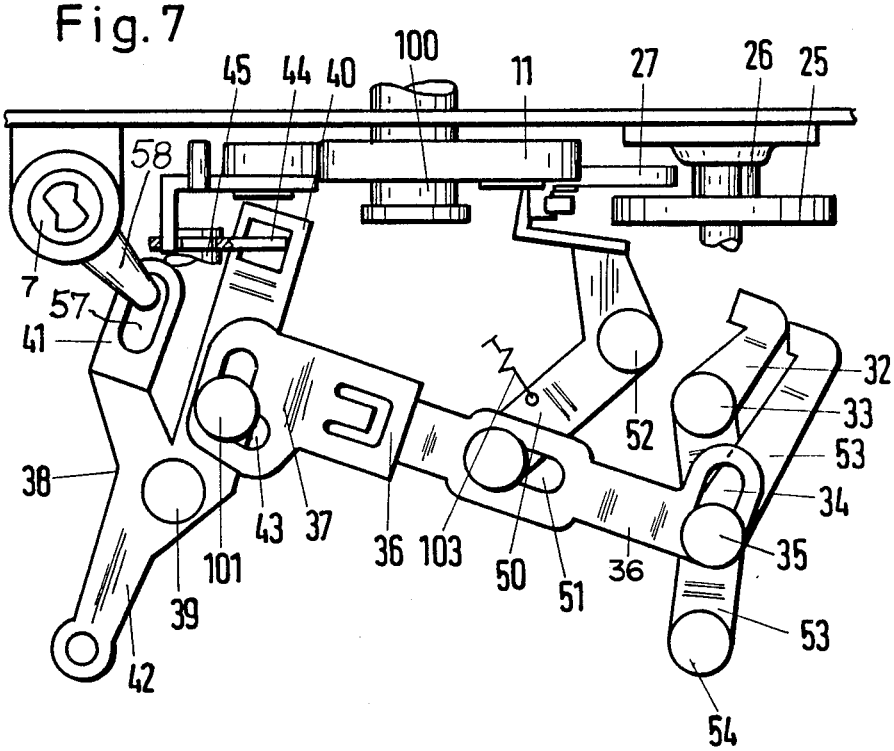
FIG. 7 is a view similar to FIG. 4, but rotated by 180° for showing the essential lock components in a preliminary or first latching position, or in the position when the door is open.

As shown in FIG. 7, the arm 40 also cooperates with a lift-out lever 44. The arm 41 is connected to the locking cylinder 7 by a cam link 58 engaging an elongated hole 57 in the arm 41, and the arm 42 is connected to the button 6 by conventional means not shown.

The safety lever 38 is also tilted about the fixed axis 39 when the tiltable lever 32 is tilted. As a result, the arm 40 of the safety lever 38 tilts a lift-out lever 44 about an axis 45 extending perpendicularly to the fixed axis 39 of the tilting lever 38. The axis 45 of the lift-out lever 44 is not fixed in the housing 8, rather, it is secured to the release lever 46 which is tiltably supported in the housing on an axis 47. The lift-out lever 44 constitutes a central control element serving for the tilting of the detent 15 best seen in FIG. 6. This operation is, however, only possible if the lift-out lever 44 bears against the detent 15. If the lift-out lever 44 is tilted away from the detent 15, as shown in full lines in FIG. 8, then the detent 15 cannot be displaced for opening the door lock 2 because any tilting of the detent 15 merely displaces the detent into the dash-dotted line position in FIG. 8.

For a central locking operation the lift-out lever 44 is tilted away from the detent 15 with the aid of the safety lever 38, whereby the lifting surface 48 of the lifting lever 44 which serves for lifting the detent 15 is moved away from the effective surface 102 of the cam 15*a* of the detent 15. The door lock 2 is thus locked and all the doors of the vehicle are centrally locked because corresponding control pulses for a central locking operation are provided by the switch 28 of the locking cylinder 7 to the electromotors 19 of the other door locks 2 of all the vehicle doors.

In order to perform the central locking operation with the aid of the button 6, that is with the transmitting lever 36, the latch fork 11 is equipped with a link control cam 49 as mentioned above for making sure that the central locking function cannot become effective when the door is open. For this purpose the link control cam 49 cooperates with a deflection lever 50 when the latch fork 11 is pulled from the first preliminary locking position into the second final locking or latching position. The deflection lever 50 engages the transmitting lever 36 in the range of a further elongated hole 51 and tilts the transmitting lever 36 about its rotational axis, or rather about the bolt 35 to which the tilting levers 32 and 53 are pivoted, whereby a form-locking connection is provided between the safety lever 38 and the L-shaped elongated hole 43. The deflection lever 50 is tiltable about an axis 52 rigidly mounted in the housing 8. A spring, or rather a tension spring 103, pulls the deflection lever 50 against the latch fork 11.

The central unlocking operation with the aid of a key in the locking cylinder 7 is also accomplished through the switch 28 which closes an energizing circuit for the electromotor 19 to rotate the drive shaft 24 and thus the cam disk 209 through an unlocking angle of 220° back to a starting position, whereby the second cam 31 tilts the second tilting lever 53 journalled on the axis 54 rigidly secured to the housing 8. Thus, as mentioned above, the shaft of the motor 19 always rotates in the same direction for the locking and for the unlocking operation. The tilting lever 53 is connected through the bolt 35 with the transmitter lever 36, whereby the lever 53 shifts the transmitter lever 36 in its longitudinal direction and opposite to the shifting direction accomplished by the other tilting lever 32 which simultaneously is returned into its starting position as shown in FIG. 4. Thus, the tilting lever 53 shifts the transmitter lever 36 in the unlocking direction so that it tilts the safety lever 38 about the fixed axis 39, whereby the lift-out lever 44 is again tilted into that position in which its lift-out surface 48 can be brought into cooperation with the effective surface 102 of the cam 15*a* of the latch fork 15 by actuating the release lever 46. Since the shaft of the motor always rotates in the same direction, the lever 32 is effective for the locking and the lever 53 is effective for the unlocking as described above.

The outer door handle 4 and the inner door handle 5 are indirectly connected with the lift-out lever 44 through the intermediate lever and link members 62 and 104, respectively. Thus, pulling the door at its outer handle 4 or at its inner handle 5 causes the lift-out lever 44 to tilt the detent 15, whereby the latch fork 11 is released and the door is opened. The lift-out lever 44 is the central and essential control element for the different opening functions of the outer door handle 4, of the door inner handle 5 and for the locking function of the door lock 2 in response to operation of the inner locking button 6. This is so because the lift-out lever 44 can either tilt the detent 15 or it cannot be brought into cooperation with the detent 15 at all.

Figure 3:
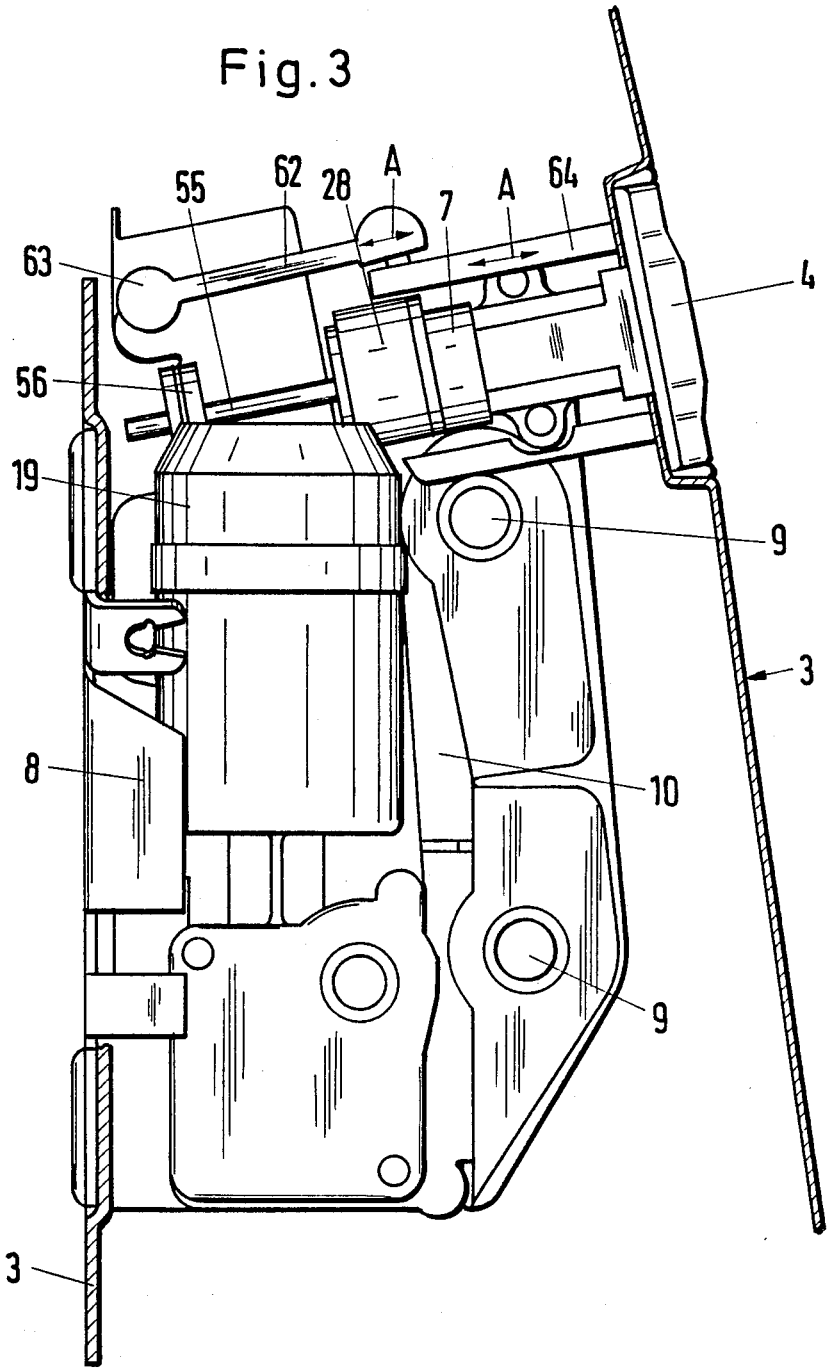
FIG. 3 is a view, partially in section, along the plane 3—3 in FIG. 1.

The locking cylinder 7 tilts the cam follower 56 by means of a cam 55 as shown in FIGS. 3 and 4. The cam 55 reaches into the cam follower 56 with a certain rotational play. Such play makes sure that upon operating the lock cylinder 7, first the switch 28 closes the energizing circuit for the electromotor 19 before the cam link 58 reaching into said elongated hole 57 of the arm 41 of the safety lever 38 can tilt the safety lever 38. Thus, if there is a power failure, the safety lever 38 can be moved with the aid of the locking cylinder 7 and thus with the aid of the key in the unlocking or in the locking direction.

A conventional linkage system not shown in the drawings, but pivoted to the arm 42 of the safety lever 38 leads to the inner door locking button 6 for releasing this button 6 with the air of the key, whereby the button 6 is lifted when the door lock is unlocked from the outside.

The outer door handle 4 is connected with the lifting lever 44 through the intermediate lever 59 and the release lever 46. The axis 60 on which the intermediate lever 59 is journalled is rigidly secured to the housing 8. The intermediate lever 59 carries a ball head 61 cooperating with a rod 62 having a spherical recess 63 engaging the ball head 61 as shown in FIGS. 3 and 4. The rod 62 is connected with a further rod or linkage system 64, whereby the rod 62 and the linkage 64 are movable in the direction of the arrows A in FIG. 3 in response to the opening and closing of the door handle 4. As a result, the intermediate lever 59 is tilted about its axis 60 and the release lever 46 is simultaneously moved by the intermediate lever 59. The release lever 46 carries the axis 45 for the lift-out lever 44, whereby as a result of tilting this axis 45, the lift-out lever 44 is moved relative to the detent 15 in such a manner that the detent 15 is tilted in the opening direction. The intermediate lever 59 further engages an arm 65 on a roller 66 which extends laterally from the release lever 46, as shown in FIG. 5.

The inner door handle 5, or rather a linkage forming part of the inner door handle 5, engages a multi-member tilting lever 67 having an arm 68 interacting directly with the release lever 46 as is primarily shown in FIG. 4.

The intermediate lever 59 has an end 69 cooperating with the roller 66 at the release lever 46, please see FIG. 5. This end 69 has a control surface 70 as shown in FIG. 5. This control surface 70 is so positioned and inclined that any friction peaks effective at rest between the latch fork 11 and the detent 15 is substantially eliminated by a continuous change in the displacement angular relationship between these components during the unlocking of the lock.

Figure 12:
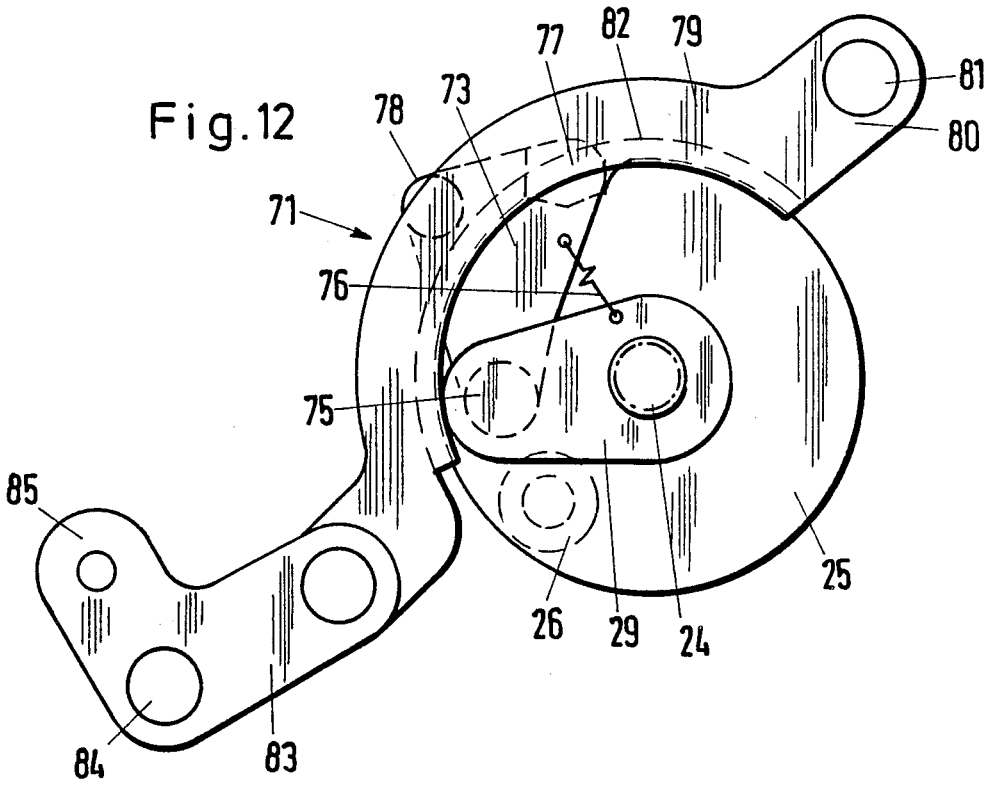
FIG. 12 is a top plan view onto lock components for an emergency opening of the lock shown in the locked position.
Figure 13:
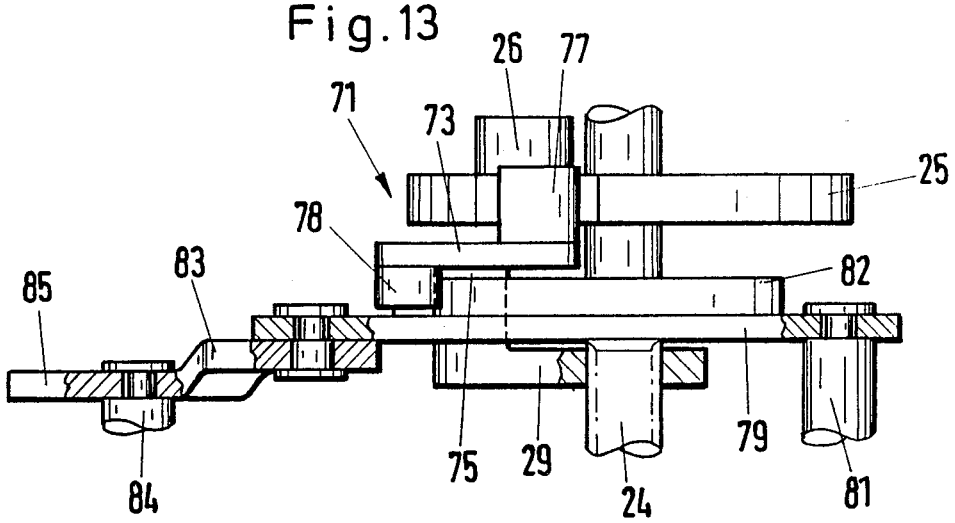
FIG. 13 is a side view of the lock components according to FIG. 12.

The door lock 2 further comprises an emergency release mechanism 71 shown in FIGS. 12 and 13. This release mechanism 71 becomes effective, for example when there is a power failure and the motor 19 has stopped in a wrong position. The release mechanism 71 comprises the above-mentioned entraining lever 73 between the drive shaft 24 and the drive disk 25 carrying a roller 26. The cam disk 25 is freely rotatable on the drive shaft 24 and is entrained when the drive shaft 24 rotates in FIGS. 5 or 6 in the counter clockwise direction because the entraining lever 73 of the release mechanism 71 reaches with its projection 77 into a recess 74 on the circumference of the drive disk 25. The entraining lever 73 is tiltable about an axis 75 secured to the cam disk 29 and biased by a spring 76 so that the entraining lever 73 is always pressed radially inwardly for engagement of its bolt type projection 77 with the recess 74 in the circumference of the drive disk 25.

Figure 14:
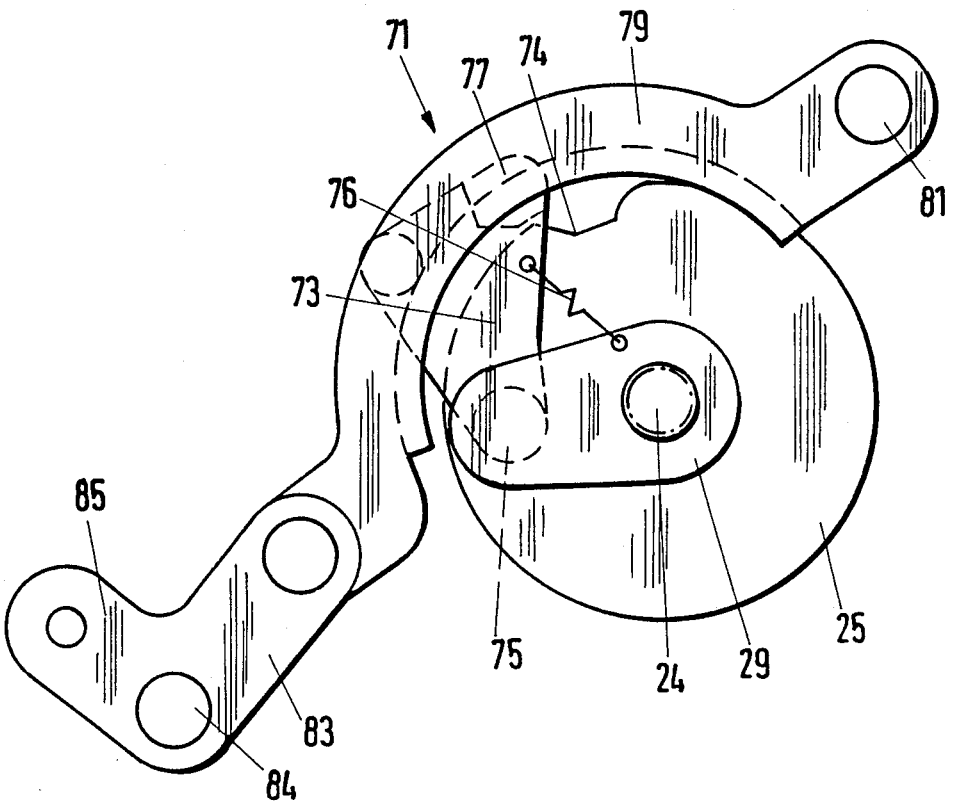
FIG. 14 is a top plan view as in FIG. 12, but the lock components in the unlocked position.

The entraining lever 73 further comprises an arbor 78 extending in parallel with the axis 75 of the entraining lever 73. The arbor 78 cooperates with an emergency release lever 79 which is tiltably supported with its end 80 on a bolt 81 secured to the housing 8. The emergency release lever 79 reaches in a semicircle around the drive disk 25 or the cam disk 29 as shown in FIGS. 12 and 14.

The emergency release lever 79 comprises a semicircular curve or guide 82 which comprises a semicircular rib. The arbor 78 on the entraining lever 73 reaches behind the curve or guide 82 as shown in FIG. 12. State differently, the arbor 78 travels on the outer surface of the curve or guide 82 for each revolution of the drive shaft 24. However, when the emergency release lever 79 is tilted away from the drive shaft 24 about the bolt 81, the emergency release lever 79 will lift the projection 77 of the entraining lever 73 out of the recess 74 of the drive disk 25 as shown in FIG. 14.

An angular lever 83 tiltable about a bolt 84 rigidly mounted in the housing 8, serves for tilting the emergency release lever 79 about the bolt 81. For this purpose the angular lever 83 has a second arm 85 pivoted at 110 to the release lever 46 as best seen in FIGS. 4 and 5. The release lever 46 is linked to the lock 7 as described above.

Further, the levers and linkage members are spring biased for properly performing all functions as far as this is necessary and as shown in the Figures.

The running surface of the latch fork operating arm 27 is curved, at 27', see FIG. 6 in order to avoid a rapid separation of the cooperating surface of the roller 26 and of the operating arm 27 under load conditions at a point of time when a bridging takes place when the door is being closed. Preferably, the curved surface has a slightly S-configuration, whereby the main latching member 13 engages the detent 15 slowly.

Figure 15:
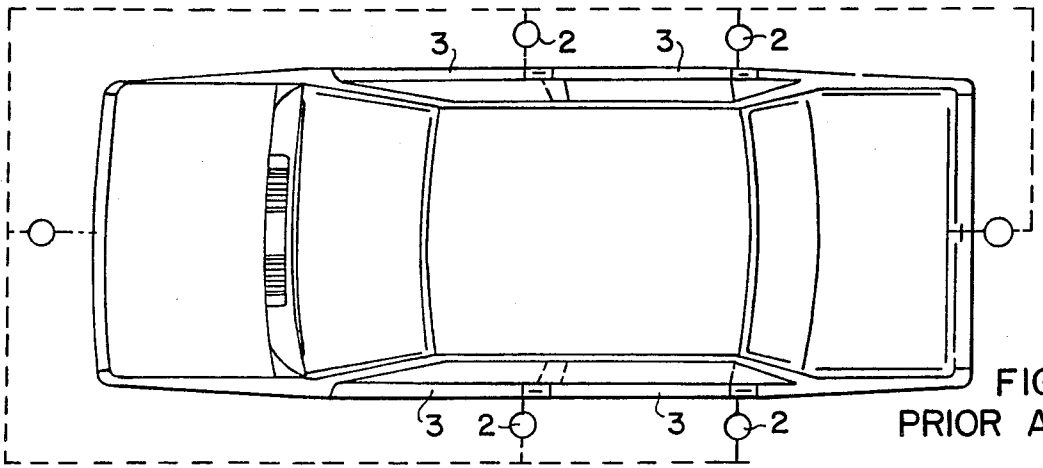
FIG.15 PRIOR ART
FIG. 15 shows schematically a conventional central locking system.

FIG. 15 shows schematically a conventional central locking system for a motor vehicle having four doors 3. Each door is equipped with a lock 2 interconnected as a central locking system. However, each lock 2 is constructed according to the invention as described above.

Although the invention has been described with reference to specific example embodiments, it will be appreciated, that it is intended to cover all modifications and equivalents within the scope of the appended claims.

What we claim is:

1. A centralized door locking system for a motor vehicle having one or more doors, comprising a door lock mechanism for each door of said motor vehicle, a central locking unit for controlling said door lock mechanism or door lock mechanisms at a single location, each door lock mechanism including lock drive means comprising an electrical drive for operating the respective door lock mechanism, said system further comprising a pull closed mechanism for each door including a latch fork (11) having a first latching member (12) for providing a preliminary latching position and a second latching member (13) for holding a respective door in a final door closed latched position, and latch fork drive means (17, 18, 25, 26, 27) operatively interposed between said latch fork (11) and said electrical drive of said lock drive means of the respective door lock mechanism for moving said latch fork (11) from said preliminary latching position into said final door closed latched position with the aid of said electrical drive, whereby said electrical drive is used for driving said door lock mechanism and for operating said pull closed mechanism.

2. The mechanism of claim 1, wherein said electrical drive is an electric motor arranged for rotating in but one and the same direction for operating said door lock mechanism and for driving said latch fork from said preliminary latched position to said final door closed latching position.

3. The system of claim 1, wherein said door lock mechanism comprises an electrical switch for operating said electrical drive, said electrical switch being located for sensing said preliminary latching position of said latch fork and for energizing said latch fork drive means for pulling said latch fork into said final door closed latched position.

4. The system of claim 1, wherein said latch fork drive means comprise an operating arm (27) and a crank type drive roller (26) for engaging said operating arm (27) for driving said latch fork from said preliminary latching position into said final door closed latched position when said crank type drive roller is driven by said electrical drive.

5. The system of claim 4, wherein said latch fork drive means comprise a drive disk (25) carrying said crank type drive roller (26).

6. The system of claim 4, wherein said operating arm (27) of said latch fork drive means comprises a curved cam surface (27') for cooperation with said drive roller (26).

7. The system of claim 6, wherein said latch fork drive means comprise a drive disk (25) carrying said crank type drive roller (26).

8. A door locking mechanism for a motor vehicle door, comprising a pull closed mechanism, door locking means for locking said door after said pull closed mechanism has pulled said door into a fully closed position, said pull closed mechanism comprising a latch fork having a first latching member for providing a preliminary latching position for said door and a second latching member for holding said door in a fully closed position, a single electrical drive motor for operating sid pull closed mechanism and said door locking means, and connecting means for operatively connecting said single electrical drive motor to said pull closed mechanism and to said door locking means, whereby said single electrical drive motor is rotatable in one direction only and is used for driving said door locking means and said pull closed mechanism while said electric drive motor is rotating in the same direction for operating said pull closed mechanism and for operating said door locking means.

* * * * *